US011004287B2

(12) United States Patent
Manuse et al.

(10) Patent No.: US 11,004,287 B2
(45) Date of Patent: May 11, 2021

(54) SEAMLESS HANDS-FREE READER ROUTE TO A DESTINATION

(71) Applicant: CARRIER CORPORATION, Palm Beach Gardens, FL (US)

(72) Inventors: Lynnette Manuse, Webster, NY (US); Eric Hartman, Pittsford, NY (US); John Marchioli, Fairport, NY (US); Kimberly Blum, Fairport, NY (US); Brijesh Raghavan, Rochester, NY (US); Nina Yakovchits, Rochester, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/403,749

(22) Filed: May 6, 2019

(65) Prior Publication Data

US 2019/0340853 A1 Nov. 7, 2019

Related U.S. Application Data

(60) Provisional application No. 62/667,764, filed on May 7, 2018.

(51) Int. Cl.
*G07C 9/27* (2020.01)
*G07C 9/00* (2020.01)
(Continued)

(52) U.S. Cl.
CPC ..... *G07C 9/27* (2020.01); *E05B 47/00* (2013.01); *G07C 9/00571* (2013.01);
(Continued)

(58) Field of Classification Search
CPC ..... G07C 9/00103; G07C 9/00031; G07C 9/00111; G07C 9/00571; G07C 9/00904; E05B 47/00
See application file for complete search history.

(56) References Cited

U.S. PATENT DOCUMENTS 3,891,980 A 6/1975 Lewis et al.
8,565,783 B2 10/2013 Yang et al.
(Continued)

FOREIGN PATENT DOCUMENTS

WO 2016166362 A1 10/2016
WO 17180563 A1 10/2017
(Continued)

*Primary Examiner* — Nabil H Syed
(74) *Attorney, Agent, or Firm* — Cantor Colburn LLP

(57) ABSTRACT

A method of providing a seamless hands-free reader route to a destination includes receiving, at a mobile device, a route from a starting point to the destination, the route including an ordered list of access control devices. An event that triggers a start of the route is detected at the mobile device. The method also includes performing, at the mobile device, for each of the access control devices in an order of the access control devices in the ordered list: scanning for a signal from the access control device; and based on receiving the signal from the access control device, transmitting a message to the access control device, the message including a request to unlock the access control device and a credential that is authorized to unlock the access control device, the credential assigned to a user of the mobile device.

18 Claims, 5 Drawing Sheets

(51) Int. Cl.
*E05B 47/00* (2006.01)
*G07C 9/22* (2020.01)
*G07C 9/28* (2020.01)

(52) U.S. Cl.
CPC ..... *G07C 9/00904* (2013.01); *G07C 9/22* (2020.01); *G07C 9/28* (2020.01); *E05B 2047/0096* (2013.01)

(56) References Cited

U.S. PATENT DOCUMENTS 8,629,755 B2 1/2014 Hashim-Waris
8,938,211 B2 1/2015 Das et al.
9,057,210 B2 6/2015 Dumas et al.
9,165,415 B2 10/2015 Park et al.
9,483,887 B1 11/2016 Soleimani
9,679,270 B2 6/2017 Zini et al.
2014/0049361 A1* 2/2014 Ahearn ..... G07C 9/00309 340/5.7
2015/0018011 A1 1/2015 Mendelson
2015/0348220 A1* 12/2015 Sharma ..... G08B 7/066 705/324
2016/0019733 A1* 1/2016 Robinton ..... G07C 9/00007 340/5.61
2017/0024839 A1* 1/2017 Klein ..... H04W 76/50
2017/0132861 A1 5/2017 Ho et al.
2017/0249794 A1* 8/2017 Davis ..... H04L 63/0861
2017/0345223 A1 11/2017 Kuenzi et al.
2018/0040182 A1 2/2018 Malhotra
2018/0096544 A1* 4/2018 James ..... G07C 9/00111
2018/0158267 A1* 6/2018 Kontturi ..... H04W 4/33
2019/0130709 A1* 5/2019 Rahut ..... G08B 13/00

FOREIGN PATENT DOCUMENTS

WO 2017180381 A1 10/2017
WO 2017180388 A1 10/2017
WO 2017180454 A1 10/2017

* cited by examiner

SEAMLESS HANDS-FREE READER ROUTE TO A DESTINATION

CROSS-REFERENCE TO RELATED APPLICATIONS

This application claims the benefit of U.S. Provisional Application No. 62/667,764 filed May 7, 2018, which is incorporated herein by reference in its entirety.

BACKGROUND

The subject matter disclosed herein generally relates to the field of access control systems, and more particularly to an apparatus and method for providing a seamless hands-free reader route to a destination.

There are many security, or access control, systems for locking and unlocking doors or portals, such as those used for ingress and egress from commercial buildings, residential buildings, and motor vehicles. Electronic security systems typically employ a credential system to determine whether an individual is authorized to unlock a particular access control device. In building complexes such as universities or office premises, seamless mobile access can be provided to controlled spaces. Seamless mobile access allows individuals who have valid mobile credentials on their mobile device to gain automatic access to a controlled space without having to reach for and click an open command from their mobile device, or present a key card to a reader on an access control device. Seamless mobile access can become a challenge when two or more access control devices, such as door locks, are adjacent each other as the strength of the signals being emitted from the access control devices can appear to be the same or nearly the same to the mobile device. In addition, individuals still have to reach for the door to open the door once it has been unlocked which can be inconvenient when carrying a lot of items.

BRIEF SUMMARY

According to an embodiment, a method of providing a seamless hands-free reader route to a destination includes receiving, at a mobile device, a route from a starting point to the destination, the route including an ordered list of access control devices. An event that triggers a start of the route is detected at the mobile device. The method also includes performing, at the mobile device, for each of the access control devices in an order of the access control devices in the ordered list: scanning for a signal from the access control device; and based on receiving the signal from the access control device, transmitting a message to the access control device, the message including a request to unlock the access control device and a credential that is authorized to unlock the access control device, the credential assigned to a user of the mobile device.

In addition to one or more of the features described above or below, or as an alternative, further embodiments of the method may include the message to the access control device further including a request to automatically open a door controlled by the access control device.

In addition to one or more of the features described above or below, or as an alternative, further embodiments of the method may include the route being generated based on an expected route of the user of the mobile device and the credential assigned to the user of the mobile device.

In addition to one or more of the features described above or below, or as an alternative, further embodiments of the method may include the route being generated by the user of the mobile device.

In addition to one or more of the features described above or below, or as an alternative, further embodiments of the method may include the route further including a timing requirement that indicates an expected amount of time for the user to move from one access control device to another access control device along the route, and the transmitting the message is further based on the timing requirement being met.

In addition to one or more of the features described above or below, or as an alternative, further embodiments of the method may include the route further including a time of day requirement that indicates a time of day that the user of the mobile device is authorized to follow the route, and the transmitting the message is further based on the time of day requirement being met.

In addition to one or more of the features described above or below, or as an alternative, further embodiments of the method may include the route further including a day of a week requirement that indicates a day of a week that the user of the mobile device is authorized to follow the route, and the transmitting the message is further based on the day of a week requirement being met.

In addition to one or more of the features described above or below, or as an alternative, further embodiments of the method may include the event that triggers a start of the route including the mobile device being proximate to a specified global positioning satellite (GPS) location.

In addition to one or more of the features described above or below, or as an alternative, further embodiments of the method may include the event that triggers a start of the route including a user request to start the route.

In addition to one or more of the features described above or below, or as an alternative, further embodiments of the method may include the receiving the signal and the transmitting the message being via a short-range wireless communication interface.

In addition to one or more of the features described above or below, or as an alternative, further embodiments of the method may include the short-range wireless communication interface being Bluetooth.

According to another embodiment, a system is configured to provide a seamless hands-free reader route to a destination. The system includes a mobile device that includes a processor and a memory having computer-executable instructions that, when executed by the processor, cause the processor to perform operations. The operations include receiving a route from a starting point to the destination, the route including an ordered list of access control devices. An event that triggers a start of the route is detected at the mobile device. The method also includes performing for each of the access control devices in an order of the access control devices in the ordered list: scanning for a signal from the access control device; and based on receiving the signal from the access control device, transmitting a message to the access control device, the message including a request to unlock the access control device and a credential that is authorized to unlock the access control device, the credential assigned to a user of the mobile device.

In addition to one or more of the features described above or below, or as an alternative, further embodiments of the system may include the message to the access control device further including a request to automatically open a door controlled by the access control device.

In addition to one or more of the features described above or below, or as an alternative, further embodiments of the system may include the route being generated based on an expected route of the user of the mobile device and the credential assigned to the user of the mobile device.

In addition to one or more of the features described above or below, or as an alternative, further embodiments of the system may include the route being generated by the user of the mobile device.

In addition to one or more of the features described above or below, or as an alternative, further embodiments of the system may include the route further including a timing requirement that indicates an expected amount of time for the user to move from one access control device to another access control device along the route, and the transmitting the message is further based on the timing requirement being met.

In addition to one or more of the features described above or below, or as an alternative, further embodiments of the system may include the route further including a time of day requirement that indicates a time of day that the user of the mobile device is authorized to follow the route, and the transmitting the message is further based on the time of day requirement being met.

In addition to one or more of the features described above or below, or as an alternative, further embodiments of the system may include the route further including a day of a week requirement that indicates a day of a week that the user of the mobile device is authorized to follow the route, and the transmitting the message is further based on the day of a week requirement being met.

According to an embodiment, a method of providing a seamless hands-free reader route to a destination includes receiving, at a mobile device, a route from a starting point to the destination, the route including a pool of access control devices. An event that triggers a start of the route is detected at the mobile device. The method also includes performing, at the mobile device, for access control devices in the pool of access control devices along the route: scanning for a signal from the access control device; and based on receiving the signal from the access control device, transmitting a message to the access control device, the message including a request to unlock the access control device and a credential that is authorized to unlock the access control device, the credential assigned to a user of the mobile device.

In addition to one or more of the features described above or below, or as an alternative, further embodiments of the method may include the message to the access control device further including a request to automatically open a door controlled by the access control device.

Technical effects of embodiments of the present disclosure include the ability improve seamless access by unlocking doors along a pre-defined path. Technical effects of embodiments of present disclosure also include hands-free access to assist individuals with heavy loads such as, but not limited to heavy boxes, items on a push cart, and or several items in their hands. Technical effects of embodiments of the present disclosure also include improved wheelchair accessibility by providing hands-free access. Technical effects of embodiments of the present disclosure can also include providing guidance for each waypoint in a route to a destination. Technical effects of embodiments of the present disclosure can also include providing mustering paths during emergencies.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

In accordance with one or more embodiments of the present invention, a hands-free reader is provided to allow a user to demonstrate intent to open a door controlled by an access control device by using a predefined a route stored on the user's mobile device. In addition to unlocking the access control device, the door controlled by the access control device can be automatically opened based on the demonstrated user intent. Accessing the access control devices readers along the path is seamless because the system recognizes the access control devices as being on the predefined route and unlocks them as the user approaches each access device. In accordance with one or more embodiments of the present invention, a received signal strength indicator (RSSI) is utilized to tune for the optimum distance to each access control device to determine when to unlock each access control device.

In an embodiment, a route can be predefined by each employee working in an office building, or office complex, based on access control devices that they already have access to. In an embodiment, a route can be attached to a credential with a temporary use for employees, maintenance personnel, vendors, visitors, etc. to allow them to enter a predefined area(s). In an embodiment, a global positioning system (GPS) location initiates a user route as a user approaches a perimeter of a facility such as an office building.

Figure 1:
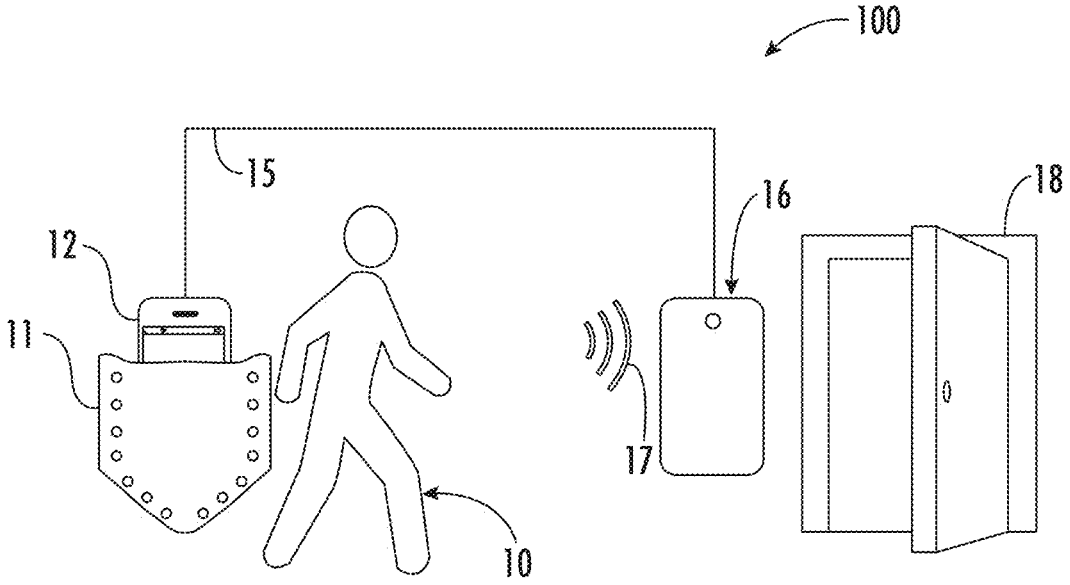
FIG. 1 illustrates a schematic diagram of a hands-free access control system, in accordance with an embodiment of the disclosure.

Turning now to FIG. 1, a schematic diagram of a hands-free access control system 100 is generally shown in accordance with an embodiment of the disclosure. The system 100 includes a door 18 providing user access into, and out of, a building, structure, room, or the like. In this embodiment, the access control device 16 is adapted to unlock the door upon receiving a message from a mobile device 12 of a user (e.g., a person 10) desiring access. The access control device 16 can also be configured to cause the door 18 to open automatically when it is unlocked so that the user can walk through in a completely hands-free manner. In accordance with an embodiment, the access control device 16 broadcasts a signal 17 to advertise its presence over a short range wireless communication interface such as Bluetooth. The mobile device 12 scans for a signal from a next access control device in a predefined route, in this case access control device 16. When the mobile device 12 detects the next access control device 16 in the predefined path, it sends a message 15 requesting access to the access control device 16 over the short range wireless communication interface. The mobile device can be located in clothing items of the person 10 or in a brief case or other item proximate to the person 10. As shown in FIG. 1, the mobile device 12 is located in a pocket 11 of the person 10.

Figure 2:
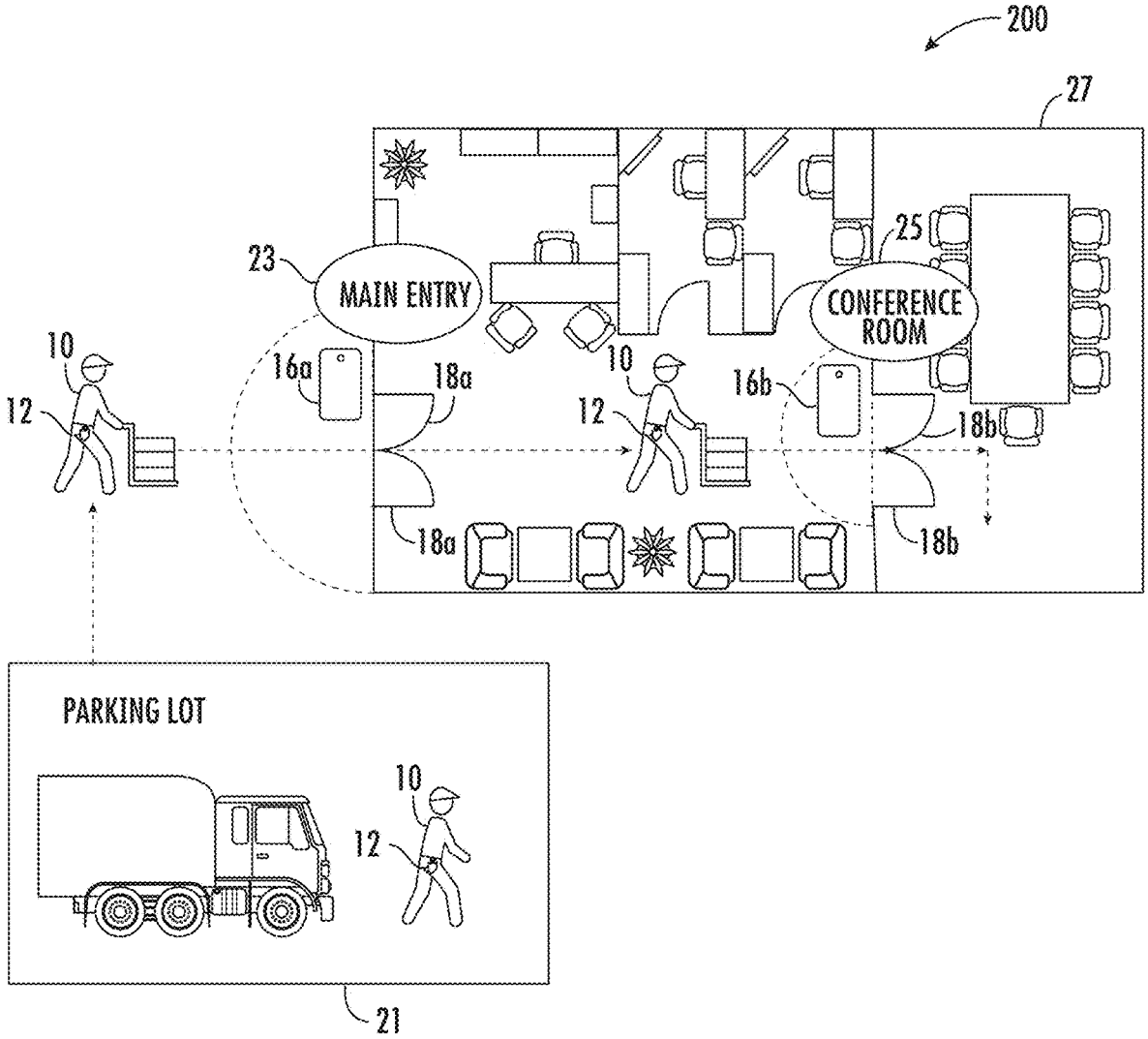
FIG. 2 illustrates a general schematic diagram of a seamless hands-free reader route to a destination, in accordance with an embodiment of the disclosure.

Turning now to FIG. 2, a general schematic diagram 200 of a seamless hands-free reader route to a destination is generally shown in accordance with an embodiment of the disclosure. The system includes a mobile device 12, access control devices 16, doors 18, and an office building 27. As shown in FIG. 2, a person 10 uses the mobile device 12 to unlock the access control devices 16 and the access control devices 16 advertise their presence to the mobile devices 12 via short-range wireless and/or near field communication methods. The state of an access control device 16 can be changed from locked to unlocked through an access request from a mobile device 12, with the correct credential, being sent to the access control device 16 via a short-range wireless communication interface) or Bluetooth interface. The short-range wireless communication interface can be implemented by any short-range wireless communication method known in the art such as, but not limited to: Wi-Fi, Bluetooth, Zigbee, and infrared.

The predefined route shown in FIG. 2 includes parking lot 21, main entry 23, and conference room 25. This predefined route could be set up for a person delivering paper to a printer in the conference room 25, or for a repair person fixing a light bulb in the conference room 25, or for an employee who regularly holds meeting in the conference room 25. The example shown in FIG. 2 shows a delivery truck containing a delivery person 10 entering a parking lot 21. The delivery person 10 has mobile device 12 with an application running in the background that detects a current GPS location as being within a predefined distance of a starting point of the predefined route. This triggers the start of a process to perform seamless hands-free route to a destination from parking lot 21 to conference room 25. This process includes scanning for the first access control device 16*a* in the predefined path.

In accordance with an embodiment, the first access control device 16*a* in the predefined path is a Bluetooth device and the mobile device 12 knows the RSSI value of the first access control device 16*a*. When the mobile device 12 is within the RSSI range of the first access control device 16*a* it triggers the unlocking of the first access control device 16*a* and optionally, the opening of the door 18*a* controlled by the first access control device 16*a*, by sending a credential of the user to the access control device 16*a*. In this manner, only the access control devices 16 along the predefined route will be unlocked when in range, while other access control devices 16 remain locked when in range or not in range.

Once the user has passed through the doors 18*a* controlled by the first access control device 16*a*, the doors 18*a* controlled by the first access control device 16*a* will lock automatically and the application on the mobile device 12 scans for the second access control device 16*b* in the predefined path. When the mobile device 12 is within the RSSI range of the second access control device 16*b* it triggers the unlocking of the second access control device 16*b* and the opening of the door 18*b* controlled by the second access control device by sending the credential of the user to the second access control device 16*b*. The predefined path can also include the reverse path back through doors 18*b* and then doors 18 so that the delivery person 10 can easily exit the building 27.

In accordance with an embodiment, the mobile device 12 displays information to provide waypoint guidance along the route. The information displayed to the person 10 can include, but is not limited to, graphics, photographs, and verbal cues.

In accordance with an embodiment, the credential(s) are unique to an individual and they expire within set amount of times. The access control devices 16 can report (e.g., to a server or to a mobile device) what credentials performed unlocks, and this can be used to identify an actual path of a person through a series of access control devices. In a situation where a building is being evacuated, this can be useful information to first responders such as firefighters to inform them of the last recorded location of a person.

Figure 3:
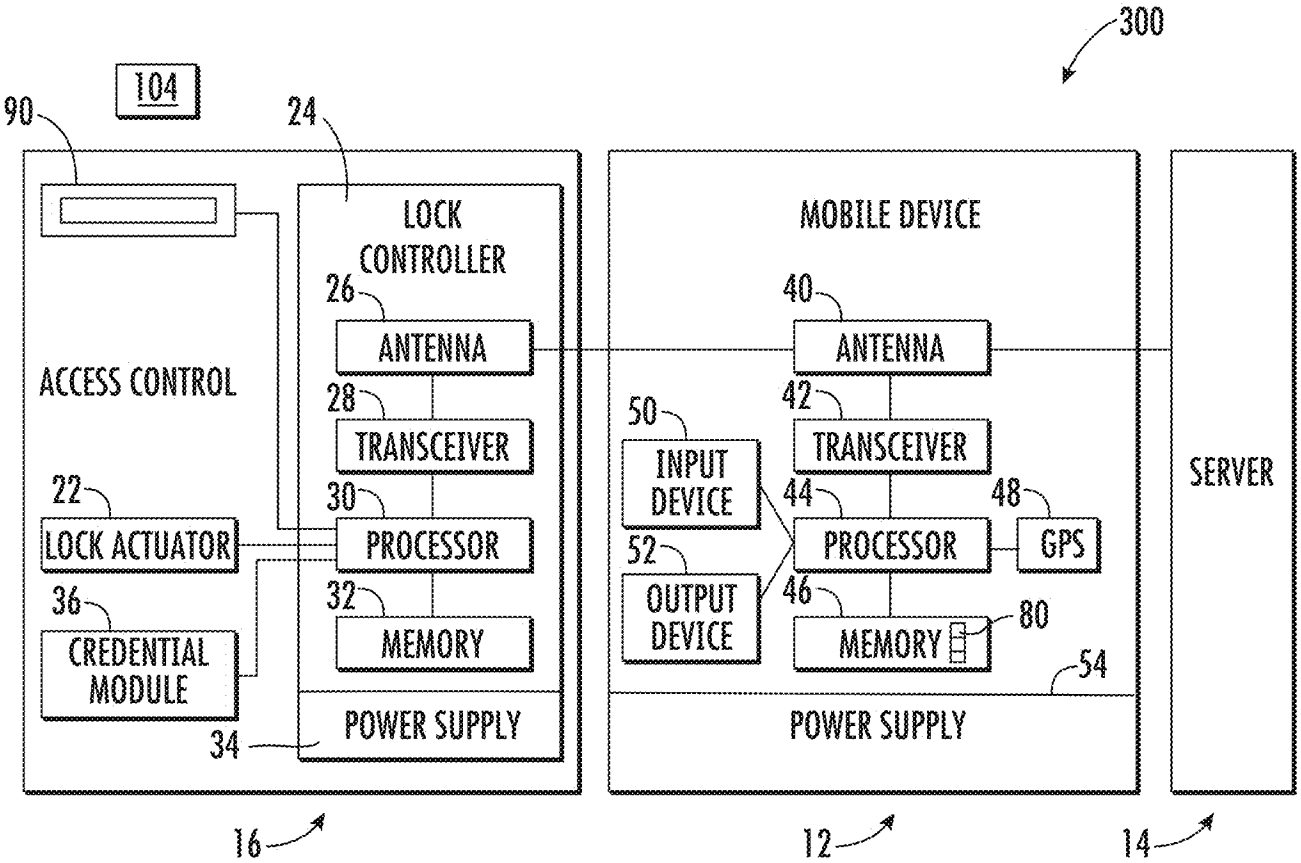
FIG. 3 illustrates a block diagram of an access control device, mobile device, and server of an access control system, in accordance with an embodiment of the disclosure.

With reference to FIG. 3, a block diagram of an example electronic lock system 300 includes the access control device 16, the mobile device 12 and a server 14. The access control device 16 generally includes a lock actuator 22, a lock controller 24, a lock antenna 26, a lock transceiver 28, a lock processor 30, a lock memory 32, a lock power supply 34, a lock card reader 90, and a credential module 36. The access control device 16 may have essentially two readers, one reader 90 to read a physical key card 104 and the credential module 36 to communicate with the mobile device 12 via the lock processor 30 and the transceiver 28 and antenna 26. The access control device 16 is responsive to credentials from the mobile device 12, and may, for example, be the lock of a turnstile or a door lock. Although the present disclosure focuses primarily on credentials for access control, it should be appreciated that other systems wherein credentials are transmitted from a mobile device to an access control device so as to identify the user to an online system or validate user access rights or permissions in an offline system will benefit herefrom.

Upon receiving and authenticating an appropriate credential from the mobile device 12 using the credential module 36, or after receiving card data from lock card reader 90, the lock controller 24 commands the lock actuator 22 to lock or unlock a mechanical or electronic lock. In this manner, a lock state of the access control device 16 changes from one state to another state. The lock controller 24 and the lock actuator 22 may be parts of a single electronic or electromechanical lock unit, or may be components sold or installed separately.

The lock transceiver 28 is capable of transmitting and receiving data to and from at least the mobile device 12. The lock transceiver 28 may, for instance, be a near field communication (NFC), Bluetooth, infrared, Zigbee, or Wi-Fi transceiver, or another appropriate wireless transceiver. The lock antenna 26 is any antenna appropriate to the lock transceiver 28. The lock processor 30 and lock memory 32 are, respectively, data processing, and storage devices. The lock processor 30 may, for instance, be a microprocessor that can process instructions to validate credentials and determine the access rights contained in the credentials or to pass messages from a transceiver to a credential module 36 and to receive a response indication back from the credential module 36. The lock memory 32 may be RAM, EEPROM, or other storage medium where the lock processor 30 can read and write. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g. turning a bolt).

While FIG. 3 shows the lock antenna 26 and the transceiver 28 connected to the processor 30, this is not to limit other embodiments that may have additional antenna 26 and transceiver 28 connected to the credential module 36 directly. The credential module 36 may contain a transceiver 28 and antenna 26 as part of the credential module. Or the credential module 36 may have a transceiver 28 and antenna 26 separately from the processor 30 which also has a separate transceiver 28 and antenna 26 of the same type or different. In some embodiments, the processor 30 may route communication received via transceiver 28 to the credential module 36. In other embodiments the credential module may communicate directly to the mobile device 12 through the transceiver 28.

The mobile device 12 generally includes a key antenna 40, a key transceiver 42, a key processor 44, a key memory 46, a GPS receiver 48, an input device 50, an output device 52, and a key power supply 54. The key transceiver 42 is a transceiver of a type corresponding to the lock transceiver 28, and the key antenna 40 is a corresponding antenna 26. In some embodiments, the key transceiver 42 and the key antenna 40 may also be used to communicate with the server 14. In other embodiments, one or more separate transceivers and antennas may be included to communicate with server 14. The key memory 46 is of a type to store a plurality of credentials locally on the mobile device 12. The mobile device 12 may also include a mobile device application 80 for implementing a mobile credentialing system. Embodiments disclosed herein, may operate through the mobile device application 80 installed on the mobile device 12.

Figure 4:
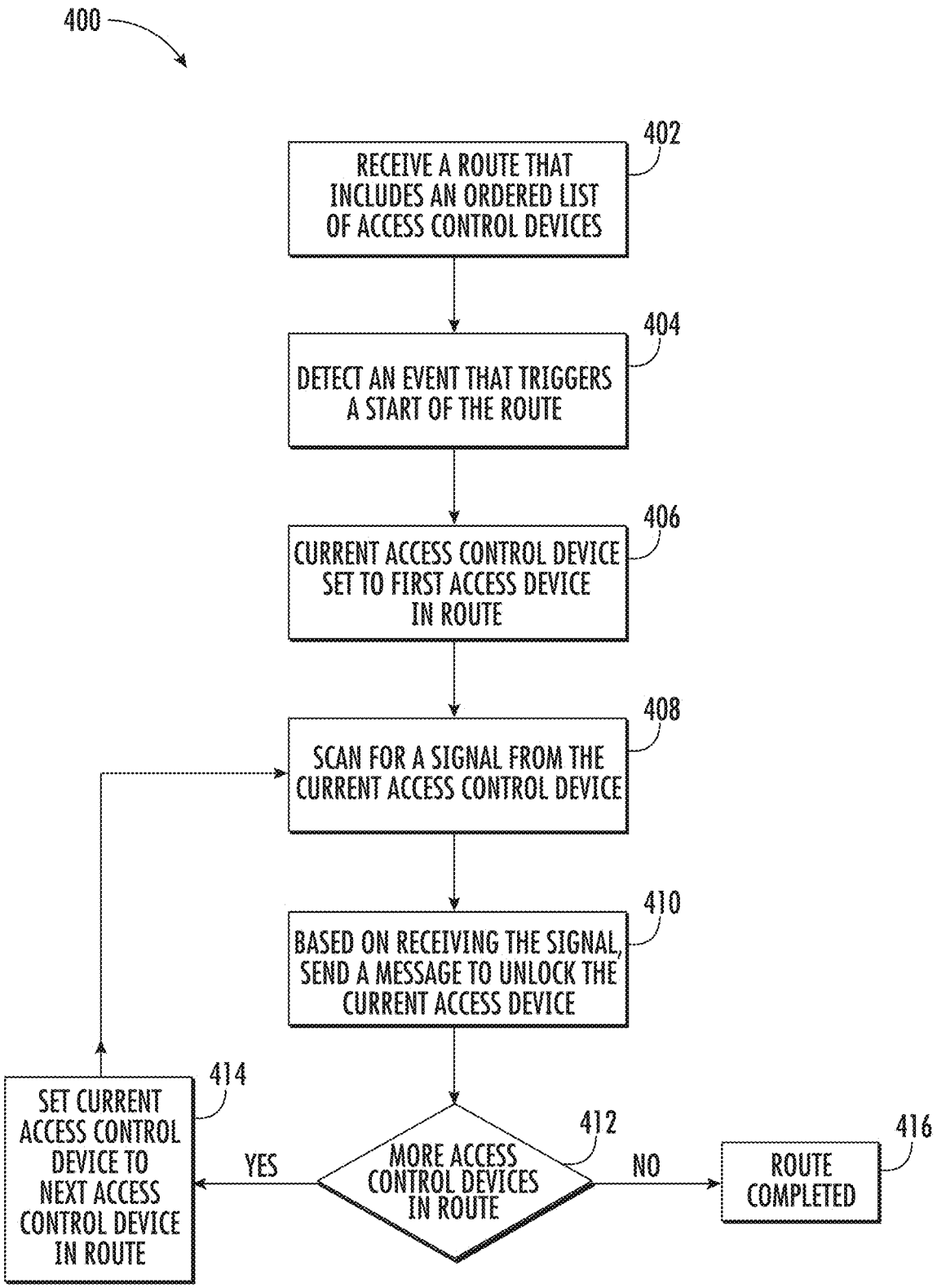
FIG. 4 is a flow diagram illustrating a method of providing a seamless hands-free reader route to a destination, in accordance with an embodiment of the disclosure.

Turning now to FIG. 4, a flow diagram 400 illustrating a method of providing a seamless hands-free reader route to a destination is generally shown in accordance with an embodiment of the disclosure. In an embodiment, the processing shown in FIG. 4 is implemented by the mobile device 12 using for example, mobile device application 80 and processor 30 of FIG. 3. At block 402, a route that includes an ordered list of access control devices, such as access control devices 16 of FIGS. 1-3, is received at a mobile device, such as mobile device 12 of FIGS. 1-3. The ordered list of access control devices represents the movement of the user along the predefined path from one access control device to the next access control device.

In an embodiment, the route is generated by software executing on a server, such as server 14 of FIG. 3, and downloaded to the mobile device 12. In another embodiment, the route is generated by software executing on the mobile device 12. The predefined route can be generated based on an expected route of the user of the mobile device and based on a credential(s) assigned to the user (so that the user has authority to unlock the access control devices 16 along the predefined route). The predefined route can be generated by the user who will be taking the route, or by an administrator who assigns the predefined route to user (possibly along with a temporary credential).

Along with an ordered list of access control devices, the predefined route can include other parameters such as an expected amount of time for the user to move from one access control device to another access control device along the route. The predefined route can be set up to deny unlock requests if the timing parameters are not met. In this manner, if a person appears to be taking an unusually long period of time moving from one access control device to a next access control device, they can be prevented from continuing along the predefined path. In an embodiment, the person is notified (e.g., via a display or other user interface of the mobile device of the user) when access to a next access control device in the predefined path has been lost due to exceeding a timing parameter. In an embodiment, an amount of time left to reach a next access control device and/or destination can be displayed on the mobile device of the user. In addition or alternatively, time of day and day of week constraints can be enforced. For example, a particular user may only be allowed to follow a predefined path during specified hours or specified days of the week.

At block 404, an event that triggers a start of the route is detected at the mobile device. The event can be detecting that the mobile device is proximate to a specified GPS location or a request from a user to start the route. In an embodiment, a user may have two or more predefined routes between a front door of an office building and an office assigned to the user. The user can select one of the predefined routes as a trigger event that starts the selected predefined route. Alternatively, the route can be selected based on a day of the week, time of the day, and/or GPS location of the user.

At block 406, the first access control device in the ordered list is set to the current access control device. The current access control device is the next access control device along the predefined route that should be unlocked. At block 408, the mobile device scans for a signal from the current access control device. At block 410, based on receiving the signal from the current access control device, a message is sent to the current access control device. The message includes a request to unlock the current access control device and a credential of the user. If the credential is authorized to unlock the current access control device, then the current access control device is unlocked and optionally a door controlled by the current access control device is automatically opened. At block 412, it is determined whether there are more access control devices in the predefined route. If there are more access control devices, then block 414 is performed and the next access control device in the ordered list is set to the current access control device and processing continues at block 408. If, as determined at block 412, the processing in blocks 408-410 has been performed for each of the access control devices in the pre-defined route, then processing continues at block 416 and the route is complete.

The door can be automatically opened using any method known in the art, and embodiments of the present invention are not limited to the manners described herein. In accordance with one or more embodiments of the present invention, in order to support automatic opening, the door is configured with a power door opener or similar capability. When the access control device receives the request to unlock the door, the access control device signals the electronic door strike to be unlocked. The signal to the electronic door strike to be unlocked can be shared in parallel with the power door opener to thereby facilitate the automatic opening of the door upon receipt of the request to unlock the door. In installations where there is no electronic door strike, when the access control device receives the request to unlock the door, the access control device can signal the power door opener to open the door directly.

While the above description has described the flow process of FIG. 4 in a particular order, it should be appreciated that unless otherwise specifically required in the attached claims that the ordering of the steps may be varied.

Figure 5:
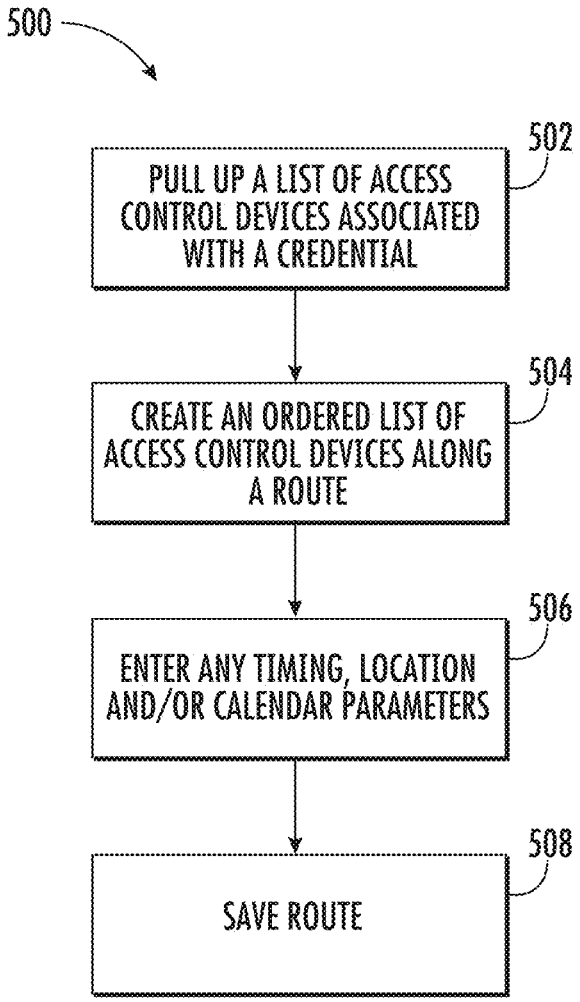
FIG. 5 is a flow diagram illustrating a method of creating a route in accordance with an embodiment of the disclosure.

Turning now to FIG. 5, a flow diagram 500 illustrating a method of creating a predefined route is generally shown in accordance with an embodiment of the disclosure. In an embodiment, the processing shown in FIG. 5 is implemented by the mobile device 12 using for example, mobile device application 80 and processor 30 of FIG. 3. In another embodiment, the processing shown in FIG. 5 is implemented by a server, such as server 14 of FIG. 3. At block 502, a list of access control devices associated with a credential are displayed on a display device (e.g., of the mobile device or server). At block 504, an ordered list of access control devices is created that includes at least a subset of the displayed access control devices. The ordered list for the predefined path in FIG. 2 can include, for example: 1. main entry access control device 16*a*; and 2. conference room access control device 16*b*.

At block 506 of FIG. 5, other parameters such as but not limited to: timing; location; and calendar dates are entered and associated with the predefined route. An example of a timing parameters include that the person is expected to move between main entry access control device 16*a* and conference room access control device 16*b* in fifteen minutes. The ability to unlock conference room access control device 16*b* can be disabled fifteen minutes after main entry access control device 16*a* is unlocked. Another example of a timing parameter is that the user can follow the predefined route during particular hours, and at other hours the path is disabled (e.g., mobile device will not initiate or request access control devices to be unlocked). A location parameter for the predefined path shown in FIG. 2 can include, for example, that GPS location of the parking lot 21. As described previously, the GPS location can be used to initiate the start of the predefined route by the user of mobile device 12. An example of a calendar parameter is that the user can follow the predefined route on particular days of the week or days of the month (e.g., specific days or relative days such as "first Tuesday") and on other days the path is disabled (e.g., mobile device will not initiate or request access control devices to be unlocked).

In addition, the timing, location, and/or calendar parameters can be used to select a particular predefined path from a plurality of predefined paths assigned to a user. For example, on Tuesday the user typically takes path "x", so on Tuesdays suggest path x. More complicated combinations are possible such as, but not limited to, when the user starts at location "y" and it is time "t" on day "d", the user typically uses predefined path "z" to go to location "l." At block 508, the route is saved. When the route is generated at the server, the predefined route can also be downloaded to a mobile device of a user associated with the predefined path.

In an embodiment, an administrator can set up a predefined route for a delivery person or maintenance person, assign them a temporary credential that allows them to unlock access control devices along the predefined route, and send the predefined route (e.g., to an item needing repair) and the temporary credential to a mobile device of the person. In this manner, customized predefined routes with temporary access can be set up to facilitate access to a facility. In an embodiment, the administrator can receive a notification upon successful completion of a route by an employee or visitor. Upon receiving the notification the administrator can revoke the temporary credential.

In an embodiment the creation of the predefined path for a user is automated based on a starting location, an ending location, and a credential that indicates which access control devices the person can access.

In an embodiment, as part of a building evacuation process, predefined paths are pushed to mobile devices of users in a building directing them to particular access control devices and to a meeting location. In this manner, mustering can be performed to allow employees to get to a secure location so that a roll call can be taken. In addition, based on conditions in the building (e.g., a fire or loss of electricity), particular access control devices can be avoided in the predefined paths.

While the above description has described the flow process of FIG. 5 in a particular order, it should be appreciated that unless otherwise specifically required in the attached claims that the ordering of the steps may be varied.

While embodiments have been described herein in terms of an ordered list of access control devices along a route, it should be appreciated that in some embodiments the defined route can be associated with a pool of access control devices (not ordered). In embodiments where a pool of unordered access devices is associated with a route, the user does not have to touch, or unlock, every access device in the route.

While embodiments have been described herein in terms of an office building, it will be appreciated that embodiments can be utilized in any environment where one or more people regularly move through the same series of locked doors.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of providing a seamless hands-free reader route to a destination, the method comprising:

receiving, at a mobile device, an evacuation route from a starting point at a current location of the mobile device to the destination, the route comprising an ordered list of access control devices, and the mobile device comprising, for each of the access control devices in the ordered list, a credential that is currently authorized to unlock the access control device, wherein a single credential is currently authorized to unlock two or more of the access control devices in the ordered list;

detecting, at the mobile device, an event that triggers a start of the route, the event comprising an evacuation process; and performing, at the mobile device, for each of the access control devices sequentially in an order of the access control devices in the ordered list:

scanning for a signal from the access control device; and based on receiving the signal from the access control device, transmitting a message to the access control device, the message comprising a request to unlock the access control device and the credential that is authorized to unlock the access control device, the credential assigned to a user of the mobile device, wherein the mobile device outputs information including verbal cues to provide waypoint guidance along the route to a user of the mobile device, and an actual evacuation path of the user is identified based on reports received from the access control devices, each report indicating that the credential assigned to the user performed an unlock of the corresponding access control device.

2. The method of claim 1, wherein the message to the access control device further comprises a request to automatically open a door controlled by the access control device.

3. The method of claim 1, wherein the route is generated based on an expected route of the user of the mobile device and the credential assigned to the user of the mobile device.

4. The method of claim 1, wherein the route is generated by the user of the mobile device.

5. The method of claim 1, wherein the route further comprises a timing requirement that indicates an expected amount of time for the user to move from one access control device to another access control device along the route, and the transmitting the message is further based on the timing requirement being met.

6. The method of claim 1, wherein the route further comprises a time of day requirement that indicates a time of day that the user of the mobile device is authorized to follow the route, and the transmitting the message is further based on the time of day requirement being met.

7. The method of claim 1, wherein the route further comprises a day of a week requirement that indicates a day of a week that the user of the mobile device is authorized to follow the route, and the transmitting the message is further based on the day of a week requirement being met.

8. The method of claim 1, wherein the receiving the signal and the transmitting the message are via a short-range wireless communication interface.

9. The method of claim 8, wherein the short-range wireless communication interface is Bluetooth.

10. A system configured to provide a seamless hands-free reader route to a destination, the system comprising a mobile device, the mobile device comprising:

a processor; and a memory comprising computer-executable instructions that, when executed by the processor, cause the processor to perform operations, the operations comprising:

receiving an evacuation route from a starting point at a current location of the mobile device to the destination, the route comprising an ordered list of access control devices, and the mobile device comprising, for each of the access control devices in the ordered list, a credential that is currently authorized to unlock the access control device, wherein a single credential is authorized to unlock two or more of the access control devices in the ordered list;

detecting an event that triggers a start of the route, the event comprising an evacuation process; and performing for each of the access control devices in an order of the access control devices in the ordered list:

scanning for a signal from the access control device; and based on receiving the signal from the access control device, transmitting a message to the access control device, the message comprising a request to unlock the access control device and a credential that is authorized to unlock the access control device, the credential assigned to a user of the mobile device, wherein the mobile device outputs information including verbal cues to provide waypoint guidance along the route to a user of the mobile device, and an actual evacuation path of the user is identified based on reports received from the access control devices, each report indicating that the credential assigned to the user performed an unlock of the corresponding access control device.

11. The system of claim 10, wherein the message to the access control device further comprises a request to automatically open a door controlled by the access control device.

12. The system of claim 10, wherein the route is generated based on an expected route of the user of the mobile device and the credential assigned to the user of the mobile device.

13. The system of claim 10, wherein the route is generated by the user of the mobile device.

14. The system of claim 10, wherein the route further comprises a timing requirement that indicates an expected amount of time for the user to move from one access control device to another access control device along the route, and the transmitting the message is further based on the timing requirement being met.

15. The system of claim 10, wherein the route further comprises a time of day requirement that indicates a time of day that the user of the mobile device is authorized to follow the route, and the transmitting the message is further based on the time of day requirement being met.

16. The system of claim 10, wherein the route further comprises a day of a week requirement that indicates a day of a week that the user of the mobile device is authorized to follow the route, and the transmitting the message is further based on the day of a week requirement being met.

17. A method of providing a seamless hands-free reader route to a destination, the method comprising:

receiving, at a mobile device, an evacuation route from a starting point at a current location of the mobile device to the destination, the route comprising a pool of access control devices, and the mobile device comprising, for each of the access control devices in the pool of access control devices, a credential that is currently authorized to unlock the access control device, wherein a single credential is currently authorized to unlock two or more of the access control devices in the pool of access control devices;

detecting, at the mobile device, an event that triggers a start of the route, the event comprising an evacuation process; and performing, at the mobile device, for access control devices in the pool of access control devices along the route:

scanning for a signal from the access control device; and based on receiving the signal from the access control device, transmitting a message to the access control device, the message comprising a request to unlock the access control device and a credential that is authorized to unlock the access control device, the credential assigned to a user of the mobile device, wherein the mobile device outputs information including verbal cues to provide waypoint guidance along the route to a user of the mobile device, and an actual evacuation path of the user is identified based on reports received from the access control devices, each report indicating that the credential assigned to the user performed an unlock of the corresponding access control device.

18. The method of claim 17, wherein the message to the access control device further comprises a request to automatically open a door controlled by the access control device.

* * * * *